US006403940B2

(12) United States Patent
Fukushima et al.

(10) Patent No.: US 6,403,940 B2
(45) Date of Patent: Jun. 11, 2002

(54) TURNTABLE DRIVE MECHANISM IN A COOKING OVEN

(75) Inventors: Kei Fukushima; Hiroshi Matsuo, both of Tsurugashima (JP)

(73) Assignee: Fujimak Corporation, Tokyo (JP)

( * ) Notice: Subject to any disclaimer, the term of this patent is extended or adjusted under 35 U.S.C. 154(b) by 0 days.

(21) Appl. No.: 09/833,876

(22) Filed: Apr. 12, 2001

(30) Foreign Application Priority Data

Apr. 20, 2000 (JP) ..... 2000-119073

(51) Int. Cl.[7] ..... H05B 6/78

(52) U.S. Cl. ..... 219/754; 219/389; 219/762; 219/757; 108/20; 126/338

(58) Field of Search ..... 219/754, 753, 219/755, 762, 389, 757; 108/20, 139; 126/338

(56) References Cited

U.S. PATENT DOCUMENTS 4,092,512 A * 5/1978 Suzuki et al. ..... 219/754
4,121,078 A * 10/1978 Takano et al. ..... 219/754
4,627,409 A * 12/1986 Kagomoto ..... 219/400

FOREIGN PATENT DOCUMENTS

JP 52-28039 * 3/1977 ..... 219/754
JP 53-30053 * 3/1978 ..... 219/754
JP 53-32436 * 3/1978 ..... 219/754

* cited by examiner

*Primary Examiner*—Philip H. Leung
(74) *Attorney, Agent, or Firm*—Frishauf, Holtz, Goodman, Langer & Chick, P.C.

(57) ABSTRACT

A turntable drive mechanism in a cooking oven. A driver unit is arranged outside a cooking chamber for rotationally driving a turntable, and a magnetic coupling is arranged between a revolving shaft of the turntable and another revolving shaft of the driver unit. The magnetic coupling is composed of a first coupling member attached to the revolving shaft of the driver unit and having magnets arranged so as to provide a surrounding of the revolving shaft with magnetic poles of alternately different polarities, and a second coupling member attached to the revolving shaft of the turntable and having magnets arranged so as to provide a surrounding of the revolving shaft with magnetic poles of alternately different polarities. The first and second coupling members face each other with a non-magnetic wall portion defining the cooking chamber being sandwiched therebetween.

6 Claims, 3 Drawing Sheets

TURNTABLE DRIVE MECHANISM IN A COOKING OVEN

FIELD OF THE INVENTION

The present invention relates to a turntable drive mechanism in a cooking oven, such as an oven, a microwave oven or the like.

DESCRIPTION OF THE PRIOR ART

A typical turntable drive mechanism in a cooking oven, such as an oven, a microwave oven or the like, conventionally has a drive motor arranged outside the oven, i.e. outside a cooking chamber in which the turntable is disposed, with a revolving shaft of the drive motor penetrating through a wall of a heating chamber to be coupled to a revolving shaft of the turntable.

However, such a motor shaft projecting inside the oven has been problematic in that it causes inconvenience upon washing the interior of the oven. Further, the through hole formed in the wall of the oven for inserting the motor shaft therethrough has made it impossible to wash the oven interior with water. Still further, there has been another problem that the oily stain accumulated on the motor shaft portion is likely to lock the motor and to obstruct a regular operation thereof, which would result in a breakdown.

Besides, there has been still another problem that when the rotary movement of the turntable is constrained for some reason, it probably leads to the breakdown of the motor which has been mechanically coupled directly with the turntable.

In addition to the above problems, for the microwave oven, the microwave heating oven or the like, which has employed a microwave heating, it has been required a preventive measure to be taken for preventing the microwave from leaking through the penetrating portion for the motor shaft.

An object of the present invention is to provide a turntable drive mechanism of a cooking oven, which can solve the problems associated with the prior technology as described above.

SUMMERY OF THE INVENTION

A turntable drive mechanism according to the present invention comprises: a support member for rotatably supporting a turntable within a cooking chamber of a cooking oven; a driver unit arranged outside said cooking chamber for rotationally driving said turntable; and a magnetic coupling arranged between a revolving shaft of said turntable and another revolving shaft of said driver unit, wherein said magnetic coupling is composed of: a first coupling member attached to said revolving shaft of said driver unit and having magnets arranged so as to provide a surrounding of said revolving shaft with magnetic poles of alternately different polarities; and a second coupling member attached to said revolving shaft of said turntable and having magnets arranged so as to provide a surrounding of said revolving shaft with magnetic poles of alternately different polarities, said first and said second coupling members being adapted to face each other with a non-magnetic wall portion defining said cooking chamber sandwiched therebetween.

According to an embodiment of the present invention, each of said first coupling member and said second coupling member comprises a plurality of magnets contained within a nonmagnetic case having a revolving shaft coupling portion which is to be coupled to either of said revolving shaft respectively.

According to another embodiment of the present invention, each of said first coupling member and said second coupling member comprises a magnet, which has been polarized to include a specified number of poles, contained within a non-magnetic case having a revolving shaft coupling portion, which is to be coupled to either of said revolving shaft respectively.

DESCRIPTION OF THE PREFERRED EMBODIMENTS

The present invention will now be described in detail with respect to embodiments thereof in conjunction with the attached drawings.

Figure 1:
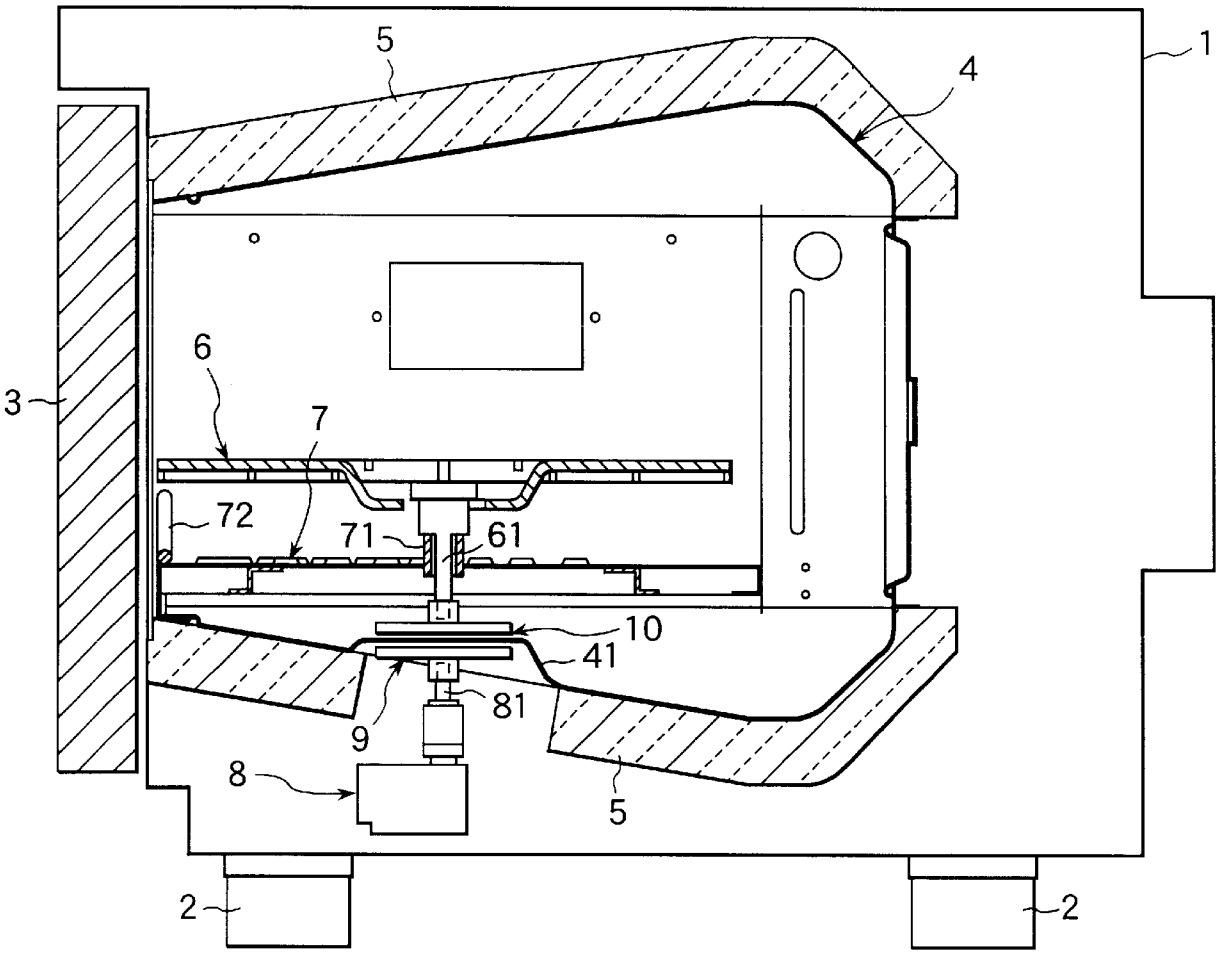
FIG. 1 is a schematic cross sectional view of a cooking oven incorporating therewith a turntable drive mechanism of an embodiment according to the present invention.

FIG. 1 is a schematic sectional view of a cooking oven incorporating therewith a turntable drive mechanism of an embodiment according to the present invention. As shown in FIG. 1, this cooking oven has an exterior housing 1 similar to that of a typical oven of this type, with legs 2 respectively attached to each of four corners of the bottom portion of the exterior housing 1. A door 3 is installed on a front face side of the exterior housing 1 to expose or close an opening through which foods to be cooked are inserted into or taken out of a cooking chamber of the oven. The cooking chamber of the oven is defined by said door 3 and a cooking chamber wall member 4 arranged in an inner side of the exterior housing 1. As typically practiced, a heat insulating material 5 is mounted on an outer side of the cooking chamber wall member 4.

The cooking chamber is designed so that a turntable 6 is disposed therein, and the turntable 6 is adapted to be rotatably supported by a support member 7 which is disposed within the cooking chamber. On the other hand, a motor 8 is arranged outside the cooking chamber and within the bottom portion of the exterior housing 1 for serving as a driver unit in order to drive the turntable 6 to rotate.

A first coupling member 9 is adapted to be fitted onto the tip portion of a motor shaft 81 which is revolved by the motor 8. On the other hand, a second coupling member 10 is adapted to be fitted to the lower end of a revolving shaft 61 of the turntable 6 which is disposed in the cooking chamber. The first coupling member 9 fitted onto the motor shaft 81 and the second coupling member 10 fitted to the revolving shaft 61 of the turntable 6 are arranged so as to closely face each other with a bottom wall portion 41 sandwiched therebetween, said bottom wall portion 41 being a part of the cooking chamber wall member 4, thus constructing a magnetic coupling as will be described later. Because of some reasons as will be explained later, at least said bottom wall portion 41 of the cooking chamber wall member 4 is preferably made of a non-magnetic material. Further, preferably the bottom wall portion 41, as obviously shown in FIG. 1, is formed into a shape having a completely horizontal area so that the first coupling member 9 and the second coupling member 10 could be placed relative to each other as closely as possible. Further, as clearly shown in FIG. 1, preferably the heat insulating material 5 disposed in the bottom portion is partially cut away in an area where the first coupling member 9 is to be located, so that the motor shaft 81 and the first coupling member 9 may revolve therein, and also the first coupling member 9 may be positioned relative to the horizontal area of the bottom wall portion 41 as closely as possible.

Figure 2:
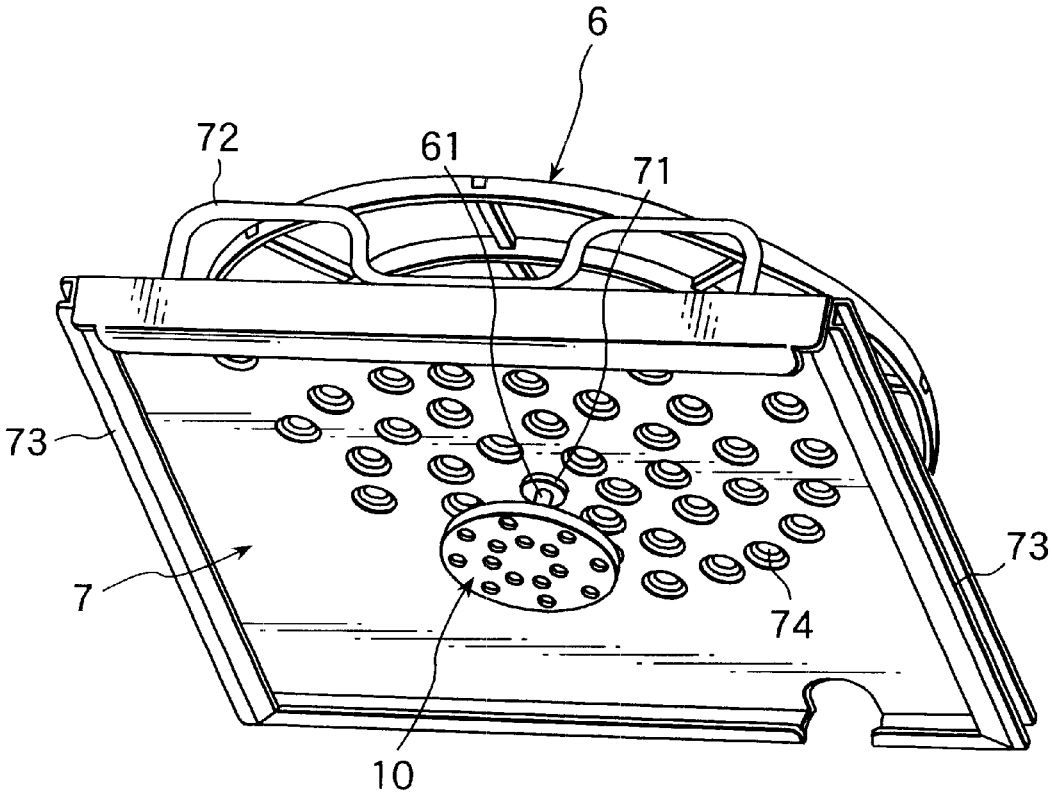
FIG. 2 is a perspective view of a combined unit body viewed from the bottom side thereof, comprising a turntable, a support member, and a second coupling member in the turntable drive mechanism of FIG. 1.
Figure 3:
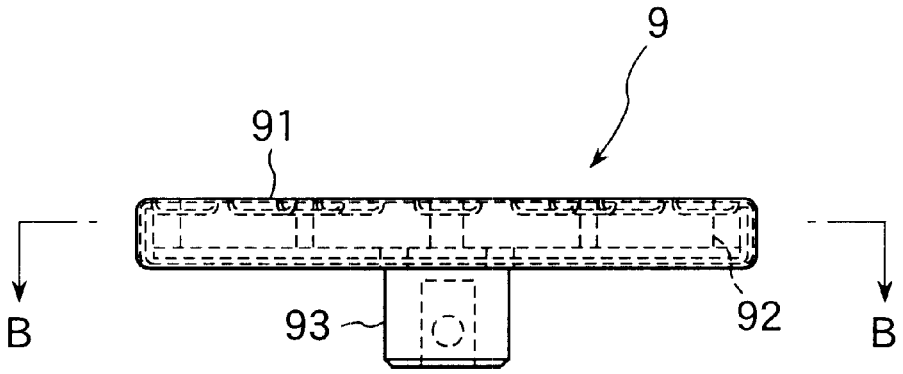
FIG. 3 is an enlarged elevational view of a first coupling member, which is to be fitted onto the tip of a motor shaft in the turntable drive mechanism of FIG. 1.
Figure 4:
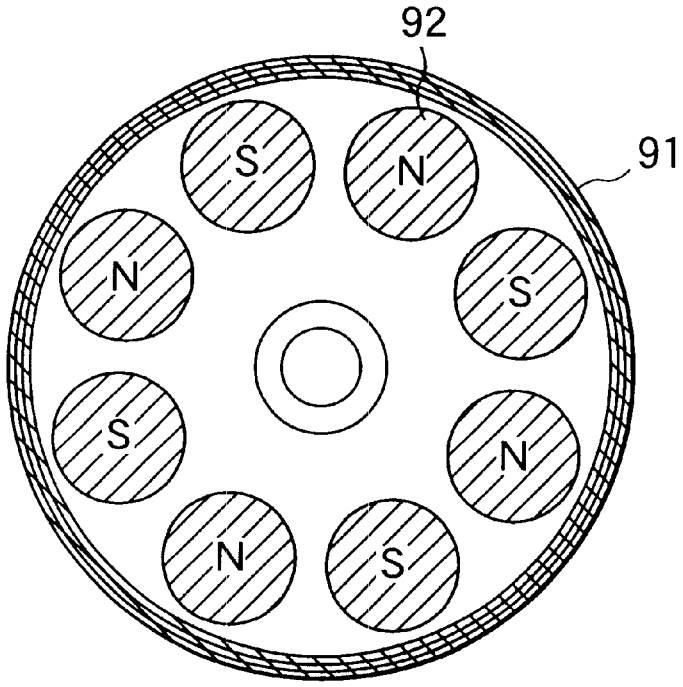
FIG. 4 is a cross sectional view taken on line B—B of FIG. 3.

Referring especially to FIGS. 2 to 4, a detailed structure and a relative positioning of the turntable 6, the support member 7, the first coupling member 9 and the second coupling member 10 will now be described in more detail.

First of all, FIG. 2 is a perspective view of a combined unit viewed from the bottom side thereof, said combined unit comprising the turntable 6, the support member 7, and the second coupling member 10. As clearly shown in FIG. 2, the support member 7 is formed into a plane table shape as a whole, and is equipped with a bearing 71 in the central portion thereof for rotatably supporting the revolving shaft 61 of the turntable 6. In this embodiment, a grip 72 is attached to the support member 7 in a front face side thereof, and a pair of channel members 73 is provided in each side of the support member 7 respectively. Further, a multiple number of holes 74 may be formed preferably in a part of the plane table section of the support member 7 corresponding to the lower side of the turntable 6 so that hot air and steam could go through the holes from an under side thereof toward the object to be cooked on the turntable 6.

The support member 7, in a condition where the turntable 6 and the second coupling 10 being mounted thereon, is adapted to be placed in the bottom portion of the cooking chamber (FIG. 1 shows exactly the support member 7 in this condition) when the channel members 73 disposed in respective sides of the support member 7 are brought into engagement with attaching guides (not shown) arranged inside the cooking chamber at locations corresponding to respective channel members 73 while being supported by hand at the grip 72 and then the support member 7 is inserted into the cooking chamber by pushing the grip 72. Also in the similar condition, this support member 7 is adapted to be taken out of the cooking chamber by holding the grip 72 and pulling it out. The combined unit composed of the support member 7, the turntable 6 and the second coupling member 10, which has been taken out of the cooking chamber, is now allowed to be disassembled into separate components and ready to be washed more easily.

FIG. 3 is an enlarged elevational view of the first coupling member 9 to be fitted onto the tip of the motor shaft 81, while FIG. 4 is a cross sectional view taken on line B—B of FIG. 3. As shown in FIGS. 3 and 4, the first coupling member 9 of this embodiment comprises a plurality of magnets 92 (eight magnets are used in this embodiment) contained within a circular flat case 91 made of non-magnetic material having a revolving shaft coupling portion 93 arranged in the center portion thereof, said revolving shaft coupling portion 93 being adapted to receive and to be operatively coupled with the tip portion of the motor shaft 81 to be rotated therewith.

As clearly shown in FIG. 4, eight pieces of magnets 92 are contained in the case so as to be arranged with equal distance surrounding the revolving shaft coupling portion 93, in such orientations that magnetic poles of different polarities are given alternately. Each of these magnets 92 may be of a circular plate shape having the N pole and the S pole along the direction of the center axis.

It should be appreciated that, although eight pieces of separate magnets are contained in the case of the present embodiment described above, the present invention is not limited to this configuration, but may employ an integrated single magnet, which has been polarized to include a specified number of poles, to be contained in the case.

As for the second coupling member 10, which is to be fitted to the lower end of the revolving shaft 61 of the turntable 6, an explanation about a detailed structure thereof will be omitted because the second coupling member 10 is substantially similar to the first coupling member 9 described with reference to FIGS. 3 and 4 with the exception that the second coupling member 10 should be fitted in inverse orientation relative to the first coupling member 9.

Then, the general operation of the drive mechanism with above configuration will be described. When foods is to be cooked in this cooking oven, first of all, if the turntable 6, the support member 7 and the second coupling member 10 have been taken out of the cooking chamber and disassembled in order to be washed, the combined unit composed of the turntable 6, the support member 7 and the second coupling member 10 has to be assembled by inserting the revolving shaft 61 of the turntable 6 through the shaft bearing 71 of the support member 7 and then fitting the second coupling member 10 to the lower end of said revolving shaft 61 projecting downwardly. Then, the door 3 of the cooking oven is opened, and the channel members 73 disposed in respective sides of the support member 7 are brought into engagement with the attaching guides (not shown) arranged inside the cooking chamber at locations corresponding to respective channel members 73 while being supported by hand at the grip 72 and then the support member 7 is inserted into the cooking chamber by pushing the grip 72. Thus, when the combined unit has been placed in the predetermined position, the second coupling member 10 fitted to the lower end of the revolving shaft 61 of the turntable 6 is in such a position where it can closely face the first coupling member 9 fitted onto the upper end of the shaft 81 of the motor 8 arranged outside the cooking chamber, with the horizontal area of the bottom wall portion 41 of the cooking chamber wall member 4 being sandwiched therebetween.

Subsequently, the food to be cooked is placed on the turntable 6 and the door 3 is closed to start the cooking operation. At that time, when the motor 8 is actuated, the motor shaft 81 rotates as followed by the first coupling member 9 to rotate. Then, the second coupling member 10, which has been faced the first coupling member 9 with the horizontal area of the non-magnetic bottom wall portion 41 being sandwiched therebetween, is caused to rotate in the same direction as that of the first coupling member 9 by the indirect magnetic force generated between the magnets 92 of the first coupling member 9 and the magnets of its own. As a result, the turntable 6 is also rotated inside the cooking chamber. Thereby, the food placed on the turntable 6 is also rotated, thus to accomplish a uniform cooking.

When the turntable, the support member, and the coupling member are moved out of the cooking chamber, there will be no projection inside the oven, and the cleaning of the interior of the oven will be facilitated.

Since there is no through hole in the bottom plate of the oven, it would be possible to wash the interior of the oven with water.

Since there is no through hole in the bottom plate, there would be no fear of the microwave leakage.

Even if the rotary movement of the turntable is constrained for some reason, the motor can independently continue to drive, and there would be no fear of the motor breakdown. That is, the magnetic coupling is also able to serve as a clutch.

Since the drive mechanism of the present invention is of a non-contact type using magnets, no precise adjustment of the size would be necessary, while disadvantageously a conventional drive mechanism employing a gear or the like needs the precise adjustment.

Since the motor is completely isolated from the oven interior, a heat inside the oven is never transferred directly to the motor via the motor shaft, thus preventing the motor from being damaged by the heat.

What is claimed is:

1. A turntable drive mechanism in a cooking oven, comprising:

a turntable;

a support member for rotatably supporting said turntable within a cooking chamber of a cooking oven;

a driver unit, arranged outside said cooking chamber for rotationally driving said turntable, and having a revolving shaft; and a magnetic coupling arranged between a revolving shaft of said turntable and said revolving shaft of said driver unit;

wherein said magnetic coupling comprises a first coupling member attached to said revolving shaft of said driver unit and having magnets arranged so as to provide a surrounding of said revolving shaft with magnetic poles of alternately different polarities; and a second coupling member attached to said revolving shaft of said turntable and having magnets arranged so as to provide a surrounding of said revolving shaft of said turntable with magnetic poles of alternately different polarities, said first and second coupling members being adapted to face each other with a non-magnetic bottom wall portion defining said cooking chamber being sandwiched therebetween; and wherein said support member is positioned within said cooking chamber above and spaced from said non-magnetic bottom wall portion, said support member having a bearing in a central portion thereof sized to receive said revolving shaft of said turntable, said bearing being arranged to support said revolving shaft of said turntable so that said turntable can be rotated, and wherein said turntable is positioned above and spaced from said support member, said support member having a plurality of holes formed in a section corresponding to a lower side of said turntable, said revolving shaft of said turntable extending through the space between said turntable and said support member and the space between said support member and said non-magnetic bottom wall portion, with an end of said revolving shaft of said turntable being close to said non-magnetic bottom wall portion, said second coupling member being attached to said end of said revolving shaft of said turntable.

2. A turntable drive mechanism in accordance with claim 1, in which each of said first coupling member and said second coupling member comprises a plurality of magnets contained within a non-magnetic case having a revolving shaft coupling portion which is adapted to be coupled to either said revolving shaft of the driver unit or said revolving shaft of the turntable.

3. A turntable drive mechanism in accordance with claim 1, in which each of said first coupling member and said second coupling member comprises a magnet, which has been polarized to include a specified number of poles, contained within a non-magnetic case having a revolving shaft coupling portion which is to be coupled to either of said revolving shafts respectively.

4. A turntable drive mechanism in a cooking oven, comprising:

a support member adapted for rotatably supporting a turntable within a cooking chamber of a cooking oven;

a driver unit, arranged outside said cooking chamber for rotationally driving said turntable and having a revolving shaft; and a magnetic coupling adapted to be arranged between a revolving shaft of said turntable and said revolving shaft of said driver unit;

wherein said magnetic coupling comprises a first coupling member attached to said revolving shaft of said driver unit and having magnets arranged so as to provide a surrounding of said revolving shaft of said driver unit with magnetic poles of alternately different polarities; and a second coupling member adapted to be attached to said revolving shaft of said turntable and having magnets arranged so as to provide a surrounding of said revolving shaft of said turntable with magnetic poles of alternately different polarities, said first and second coupling members being adapted to face each other with a non-magnetic bottom wall portion defining said cooking chamber being sandwiched therebetween; and wherein said support member is positioned within said cooking chamber above and spaced from said non-magnetic bottom wall portion, said support member having a bearing in a central portion thereof sized to receive said revolving shaft of said turntable, said bearing being adapted to support said revolving shaft of said turntable so that said turntable can be rotated, and wherein said turntable is adapted to be positioned above and spaced from said support member, said support member having a plurality of holes formed in a section adapted to correspond to a lower side of said turntable, said revolving shaft of said turntable being adapted to extend through the space between said turntable and said support turntable, said revolving shaft of said turntable being adapted to extend through the space between said turntable and said support member and the space between said support member and said nonmagnetic bottom wall portion, with an end of said revolving shaft being close to said non-magnetic bottom wall portion, said second coupling member being adapted to be attached to said end of said revolving shaft of said turntable.

5. A turntable drive mechanism in accordance with claim 4, in which each of said first coupling member and said second coupling member comprises a plurality of magnets contained within a non-magnetic case having a revolving shaft coupling portion which is adapted to be coupled to either said revolving shaft of the driver unit or said revolving shaft of the turntable.

6. A turntable drive mechanism in accordance with claim 4, in which each of said first coupling member and said second coupling member comprises a magnet, which has been polarized to include a specified number of poles, contained within a nonmagnetic case having a revolving shaft coupling portion which is to be coupled to either said revolving shaft of the driver unit or said revolving shaft of said turntable.

* * * * *